US012152773B2

(12) United States Patent
Tsai

(10) Patent No.: US 12,152,773 B2
(45) Date of Patent: Nov. 26, 2024

(54) SAFETY SWITCH FOR USE IN GAS COMBUSTOR

(71) Applicant: ROBURN COMPANY LTD., New Taipei (TW)

(72) Inventor: Chin-Lin Tsai, New Taipei (TW)

(73) Assignee: ROBURN COMPANY LTD., New Taipei (TW)

( * ) Notice: Subject to any disclaimer, the term of this patent is extended or adjusted under 35 U.S.C. 154(b) by 568 days.

(21) Appl. No.: 17/331,418

(22) Filed: May 26, 2021

(65) Prior Publication Data

US 2021/0381689 A1 Dec. 9, 2021

(30) Foreign Application Priority Data

Jun. 4, 2020 (TW) ..... 109207044

(51) Int. Cl.

| | |
|---|---|
| ***F23D 14/28*** | (2006.01) |
| ***F23D 14/38*** | (2006.01) |
| ***F23D 14/46*** | (2006.01) |
| ***F23D 14/72*** | (2006.01) |
| ***F23K 5/00*** | (2006.01) |
| ***F23N 1/00*** | (2006.01) |
| *F23M 11/00* | (2006.01) |
| *F23Q 3/00* | (2006.01) |
| *F23Q 25/00* | (2006.01) |

(52) U.S. Cl.

CPC ..... *F23D 14/72* (2013.01); *F23D 14/28* (2013.01); *F23D 14/38* (2013.01)

(58) Field of Classification Search

CPC ..... F23D 14/28; F23D 14/38; F23D 14/72

See application file for complete search history.

(56) References Cited

U.S. PATENT DOCUMENTS

| | | | | |
|---|---|---|---|---|
| 1,830,580 | A * | 11/1931 | Wappat | B27B 9/02 30/376 |
| 5,577,600 | A * | 11/1996 | Schoene | H01H 3/20 200/321 |
| 6,293,782 | B1 | 9/2001 | Tsai | |
| 6,296,476 | B1 | 10/2001 | Tsai | |
| 6,527,543 | B2 | 3/2003 | Tsai | |
| 7,708,554 | B2 | 5/2010 | Tsai | |
| 7,850,446 | B2 | 12/2010 | Tsai | |
| 2002/0056618 | A1 * | 5/2002 | Bascom | H01H 3/20 200/43.17 |

(Continued)

*Primary Examiner* — Jorge A Pereiro
*Assistant Examiner* — Logan P Jones
(74) *Attorney, Agent, or Firm* — Guice Patents PLLC

(57) ABSTRACT

A safety switch for use in a gas combustor is disposed on a gas combustor having a rear opening, and a press button is arranged adjacent to the rear opening; the safety switch includes a locking member and a swing arm, the locking member has a main body sleeved with a longitudinal spring, and a locking hook protruded from a location towards a latching hook arranged above the swing arm, wherein a transversal spring is disposed between an extending sheet below the swing arm and the inner wall of the gas combustor; when the locking member is not pressed, the locking hook is abutted against the latching hook, a locking bolt protruded from a bottom end of the press button is abutted against the locking hook, so that the press button is unable to be pressed, thereby forming a locked status.

6 Claims, 10 Drawing Sheets

(56) References Cited

U.S. PATENT DOCUMENTS

| | | | | |
|---|---|---|---|---|
| 2002/0106601 | A1* | 8/2002 | Adams | F23Q 2/164<br>431/255 |
| 2008/0057455 | A1* | 3/2008 | Tsai | F23Q 2/164<br>431/153 |
| 2012/0244480 | A1* | 9/2012 | Tsai | F23D 14/28<br>431/153 |
| 2019/0093889 | A1* | 3/2019 | Ho | F23D 14/72 |

* cited by examiner

A-A

B-B

C-C

SAFETY SWITCH FOR USE IN GAS COMBUSTOR

BACKGROUND OF THE INVENTION

Field of the Invention

The present invention relates to a safety switch, especially to a safety switch for use in a gas combustor. A locked status is formed when the safety switch is not in an operating status, and actions of pressing for supplying fuel gas and igniting can be processed when the safety switch is in an unlocked status.

Description of the Related Art

With the development of living conditions and technologies, a lighter has been used for replacing matches as a device for getting a fire source, take a conventional gas combustor as an example, because the gas combustor is able to provide a stronger flame, can be held and operated by single hand and be conveniently carried around, the gas combustor has been popular and commonly used by consumers.

The gas combustors are commonly seen and used in our daily lives. But for a child, he/she may play with a gas combustor without being supervised because of his/her curiosity or imitating the adults. Therefore, a fire accident may occur due to the careless act and our lives and properties may be in danger. As such, in many cases, fire accidents caused by children playing with fire cannot be ignored. The main reason for the above-mentioned shortage is that the design of ignition switch is easy to be operated based on the object of convenient in use, thus the children may take a chance to play with the gas combustor, and unpredictable consequences become inevitable.

For safety reasons, various countries have issued safety regulations regarding to the gas combustor, and each gas combustor is required to be installed with a safety switch, take U.S. Pat. No. 6,293,782 (corresponding to Taiwan Patent No. 446104), U.S. Pat. No. 6,296,476 (corresponding to Taiwan Patent No. 449018), U.S. Pat. No. 6,527,543 (corresponding to Taiwan Patent No. 525749), U.S. Pat. No. 7,708,554 (corresponding to Taiwan Patent Registration No. M306647) and U.S. Pat. No. 7,850,446 (corresponding to Taiwan Patent Registration No. M338954) issued to the applicant of the present invention for instances, when a gas combustor is not operated, the above-mentioned safety switch is in a locked status; if the gas combustor is desired to be operated, the safety switch has to be released for allowing actions of pressing for supplying fuel gas and igniting to be processed. Because the unlocking procedure increases the level of difficulty in use, a child could not release the locked status while playing with the gas combustor, thereby decreasing occurrences of accidents.

As such, additionally disposing a safety switch on a gas combustor for complying with the safety regulations issued by various countries shall be seriously concerned by the skilled people in the art.

SUMMARY OF THE INVENTION

One primary objective of the present invention is to provide a safety switch for use in a gas combustor, which is provided with dual functions of manual unlocking and automatic locking, thereby increasing the safety in operation and the durability in service life.

For achieving said objective, one technical solution provided by the present invention is to provide a safety switch for use in a gas combustor, which is disposed on a gas combustor having a rear opening, and a press button is arranged adjacent to the rear opening; the safety switch includes a locking member and a swing arm arranged to be adjacent to the locking member and pivotally connected to an inner wall of the gas combustor, the locking member has a main body sleeved with a longitudinal spring, the main body has a push piece protruded from the rear opening, and a locking hook protruded from a location towards a latching hook arranged above the swing arm, wherein a transversal spring is disposed between an extending sheet below the swing arm and the inner wall of the gas combustor; when the push piece is not pressed, the locking hook is abutted against the latching hook, a locking bolt protruded from a bottom end of the press button is abutted against the locking hook, so that the press button is unable to be pressed, thereby forming a locked status; when the push piece is longitudinally and downwardly pressed, the longitudinal spring is compressed, and the locking hook of the main body is downwardly displaced along the latching hook so as to form a mutual abutting status, thus the locking bolt is no longer provided with an abutting effect of the locking member, thereby forming a pressing unlocked status and the latching hook is released from the locking hook, and the locking member is upwardly displaced through an energy releasing effect of the longitudinal spring, and a top surface of the locking hook is in contact with the locking bolt.

According to one embodiment of the present invention, a top end of the longitudinal spring is received in a spring slot formed in the bottom end of the main body, and a bottom end thereof is abutted against the abutting sheet arranged below the rear opening.

According to one embodiment of the present invention, a slide rail mechanism is oppositely disposed on at least one lateral wall of the main body and a corresponding inner wall of the gas combustor.

According to one embodiment of the present invention, the slide rail mechanism has at least one convex rail and at least one slide rail allowing the at least one convex rail to be disposed, so that the locking member is able to elastically and longitudinally move in the rear opening through the slide rail mechanism.

According to one embodiment of the present invention, the swing arm has a shaft hole, the shaft hole is sleeved on a shaft column protruded from the inner wall of the gas combustor.

According to one embodiment of the present invention, one end of the transversal spring is sleeved with an spring tenon of the extending sheet, and another thereof is abutted against the inner wall of the gas combustor.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

Figure 1:
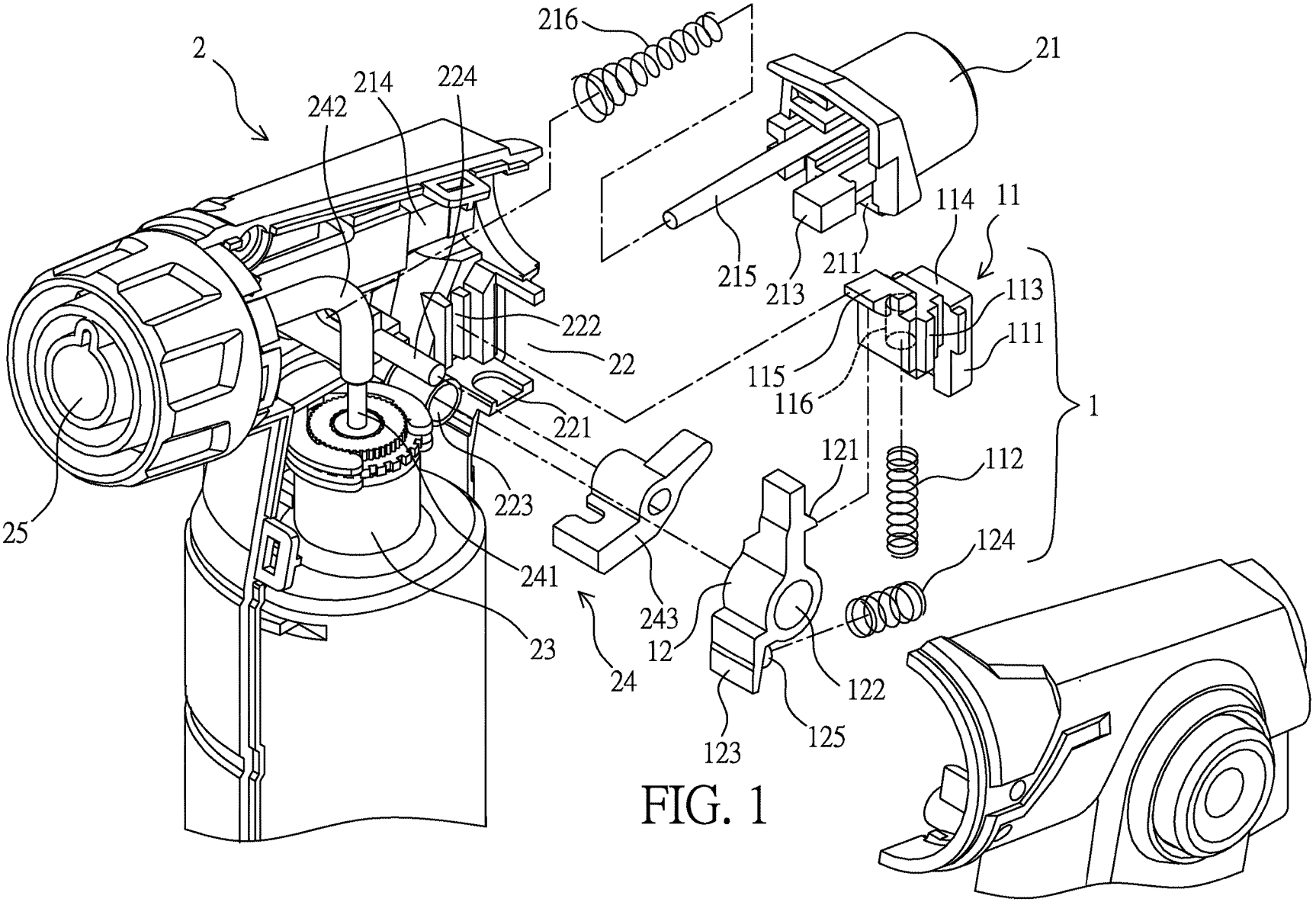
FIG. 1 is a perspective exploded view illustrating a safety switch and a gas combustor according to the present invention.

Please refer from FIG. 1 to FIG. 6, the present invention provides a safety switch 1 disposed on a gas combustor 2 for enabling a press button 21 of the gas combustor 2 to be in a locked status, thereby preventing from being misused by children.

The safety switch 1 is disposed in a rear opening 22 of the gas combustor 2, and arranged below the press button 21. The safety switch 1 has a locking member 11, and a swing arm 12 adjacently arranged with the locking member 11.

The locking member 11 has a main body 111, a longitudinal spring 112 is disposed at a bottom end of the main body 111, a bottom end of the longitudinal spring 112 is abutted against an abutting sheet 221 arranged below the rear opening 22, so that the locking member 11 is able to longitudinally and elastically move in the rear opening 22. A slide rail mechanism, for example at least one convex rail 113 and at least one slide rail 222 allowing the at least one convex rail 113 to be disposed, is oppositely disposed on at least one lateral wall of the main body 111 and a corresponding inner wall of the gas combustor 2, so that the locking member 11 is able to elastically and longitudinally move in the rear opening 22 through the slide rail mechanism.

Moreover, the main body 111 has a push piece 114 protruded from the rear opening 22, and a locking hook 115 protruded from a location towards a latching hook 121 arranged above the swing arm 12. Please refer to FIG. 5, when the locking member 11 is not downwardly pressed, the locking hook 115 is abutted against the latching hook 121 of the swing arm 12. A top end of the longitudinal spring 112 is received in a spring slot 116 formed in the bottom end of the main body 111, and the bottom end thereof is abutted against the abutting sheet 221. A locking bolt 211 protruded from a bottom end of the press button 21 is abutted against the locking hook 115, so that the press button 21 is unable to be pushed, thereby forming a locked status.

Figure 5:
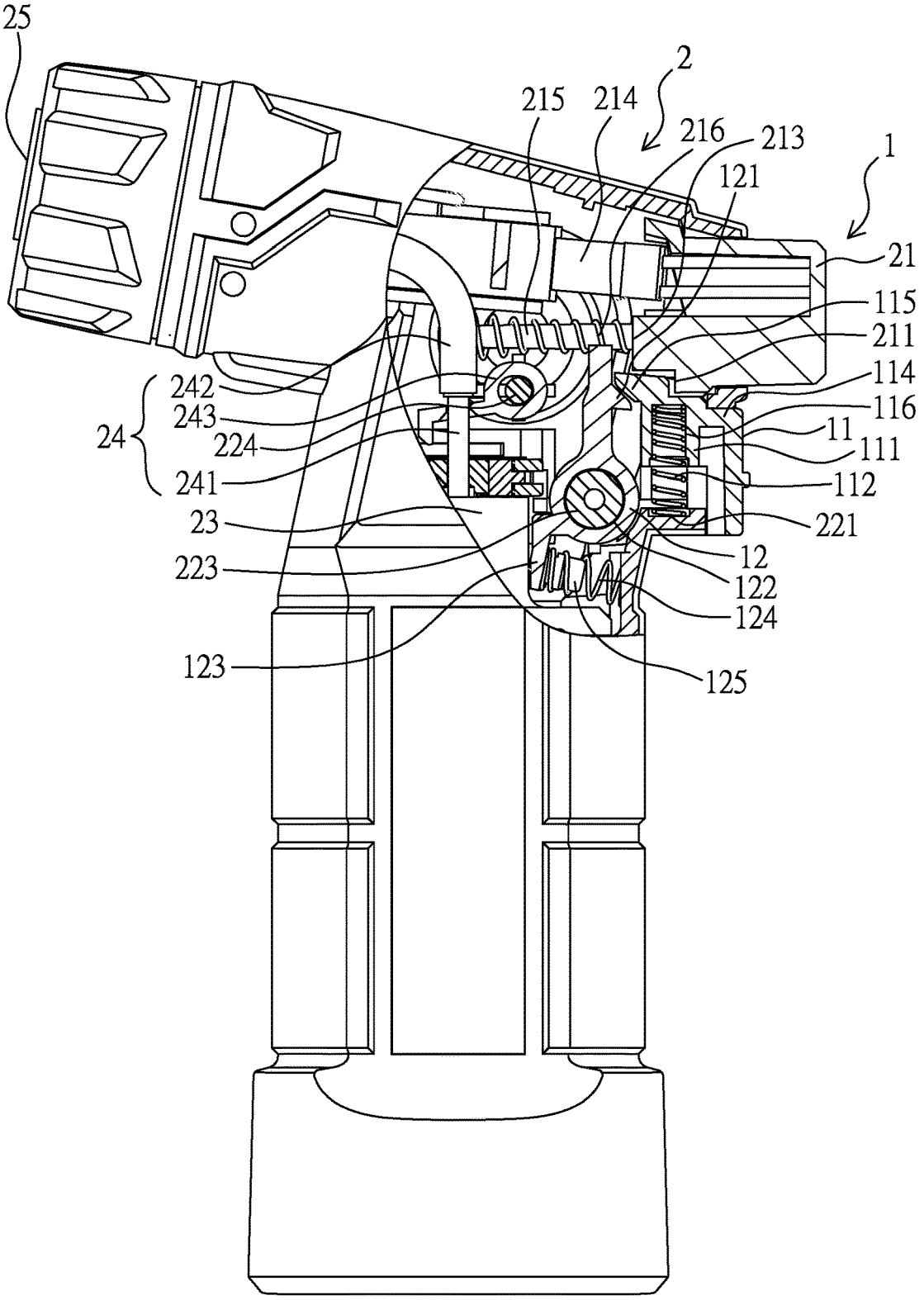
FIG. 5 is a partial cross sectional view of FIG. 3 taken along a B-B line.

The swing arm 12 has a shaft hole 122 which is sleeved on a shaft column 223 protruded from the inner wall of the gas combustor 2, and a transversal spring 124 is disposed between an extending sheet 123 below the shaft hole 122 of the swing arm 12 and the inner wall of the gas combustor 2. As shown in FIG. 5, when the press button 21 is in the automatic locked status, the swing arm 12 is able to counterclockwise rotate with an energy releasing effect provided by the transversal spring 124, and the latching hook 121 is abutted against the locking hook 115. One end of the transversal spring 124 is sleeved with a spring tenon 125 of the extending sheet 123, and another thereof is abutted against the inner wall of the gas combustor 2.

Figure 2:
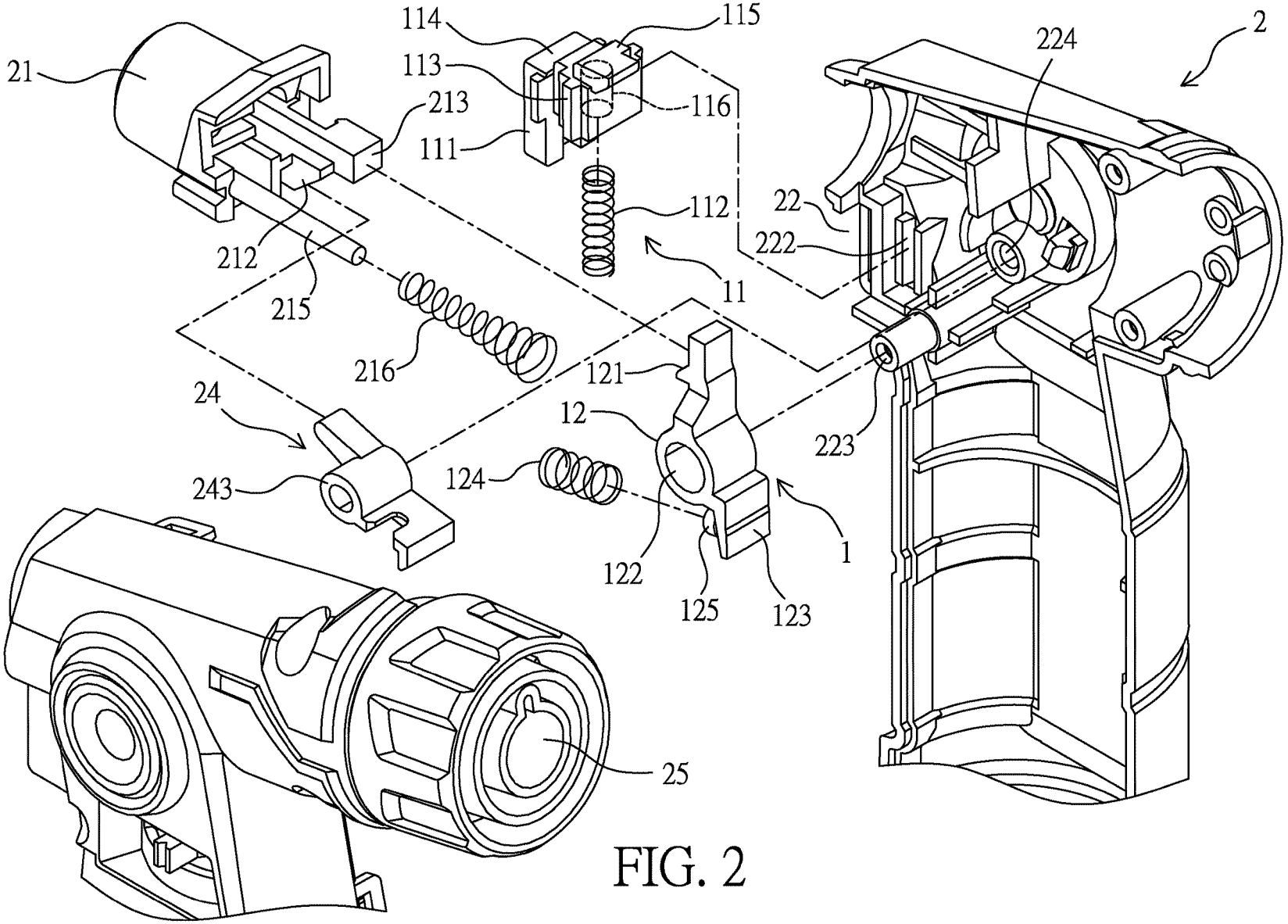
FIG. 2 is another perspective exploded view illustrating the safety switch and the gas combustor according to the present invention.
Figure 3:
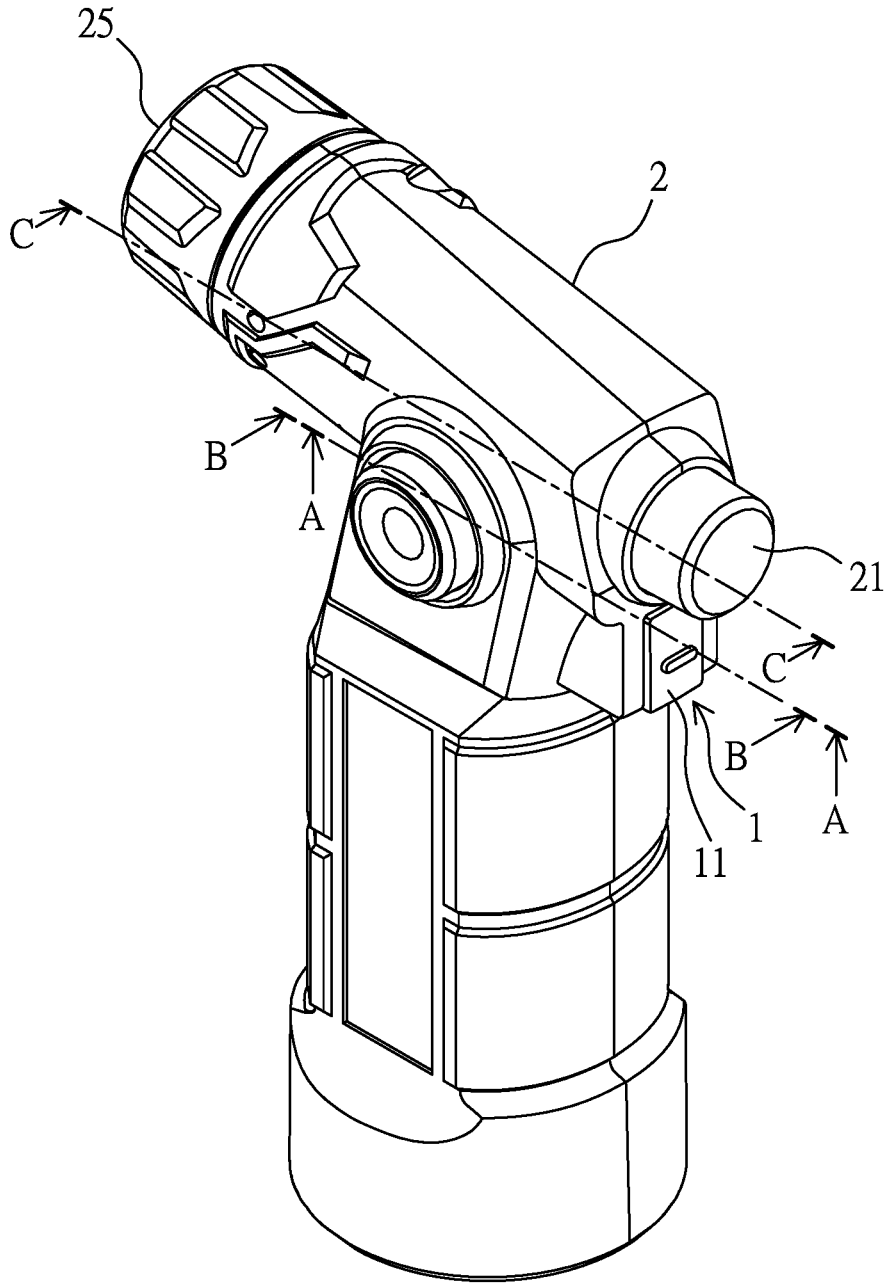
FIG. 3 is a perspective view illustrating the safety switch being disposed on the gas combustor according to the present invention.
Figure 4:
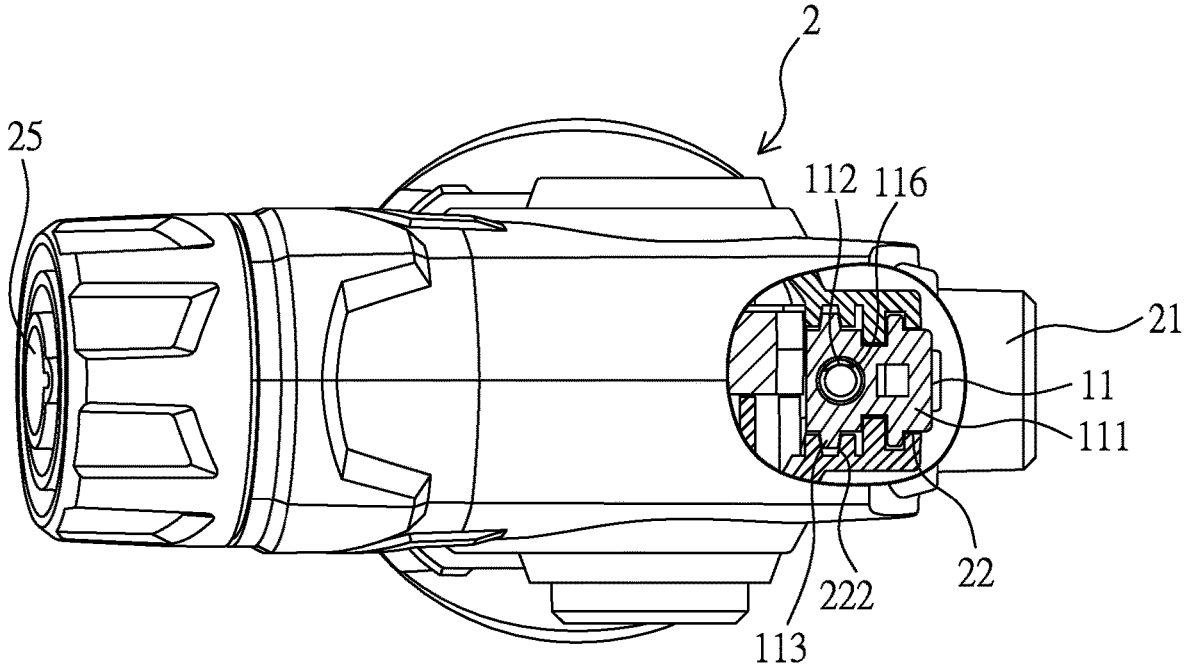
FIG. 4 is a partial cross sectional view of FIG. 3 taken along an A-A line.
Figure 6:
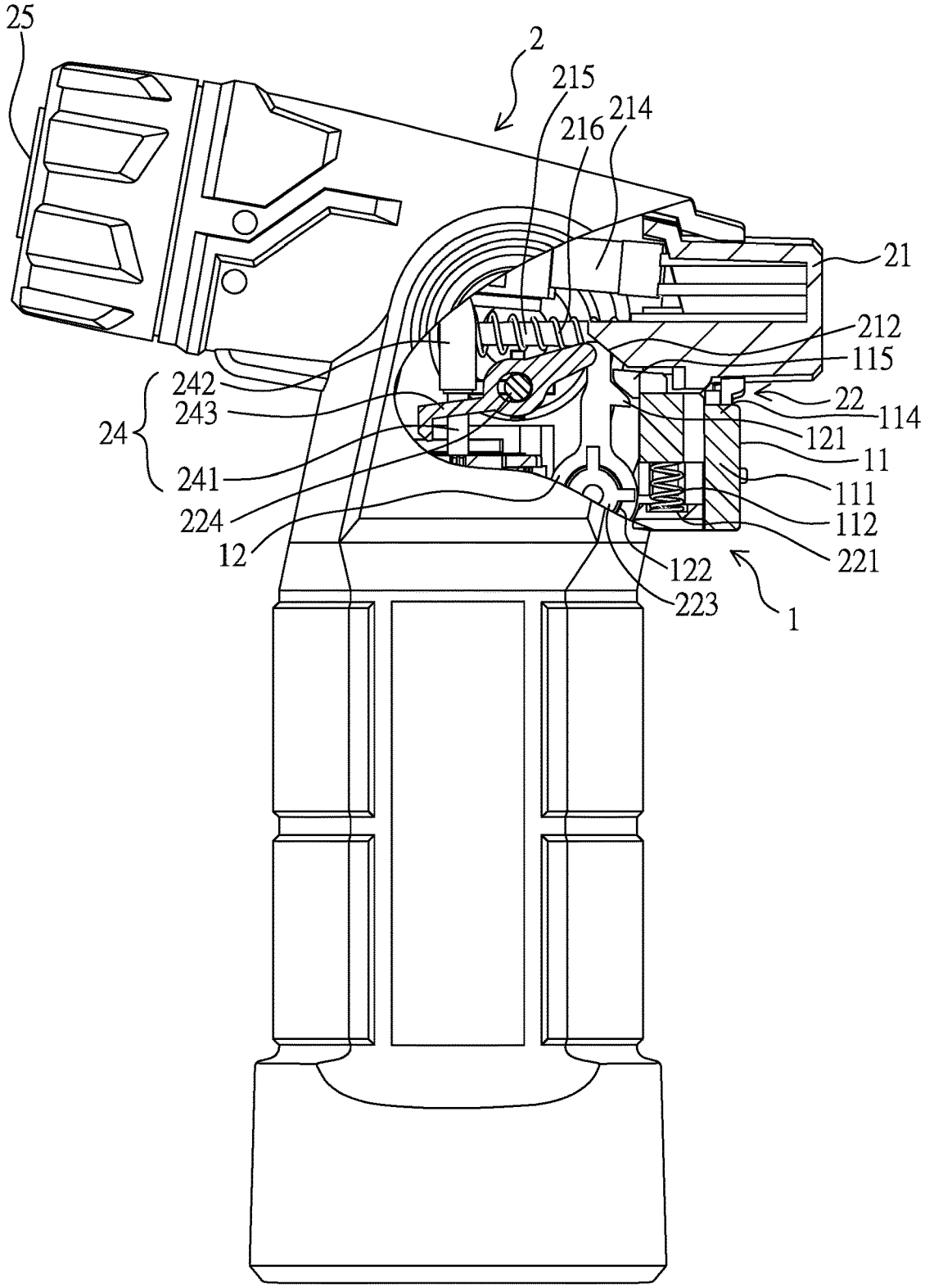
FIG. 6 is a partial cross sectional view of FIG. 3 taken along a C-C line.

According to what has been disclosed above, the locking member 11 and the swing arm 12 are disposed in the rear opening 22 of the gas combustor 2, thereby structuring the safety switch 1 as shown from FIG. 1 to FIG. 3, the cross section of the assembled safety switch 1 is shown from FIG. 4 to FIG. 6. A manual unlocking operation and an automatic locking operation of the safety switch 1 and the press button 21 are provided in the follows.

A storage cylinder 23 used for storing conventional liquid gas is disposed in the gas combustor 2, a top end of the storage cylinder 23 is disposed with a fuel gas controlling device 24, the fuel gas controlling device 24 has a gas discharging nozzle 241 used for controlling whether fuel gas to be supplied or not, the gas discharging nozzle 241 is sleeved with one end of a gas conveying pipe 242, another end of the gas conveying pipe 242 is sleeved with a gas ejecting nozzle (known as a prior art therefore not shown in figures). When the gas discharging nozzle 241 is lifted, the liquid gas in the storage cylinder 23 is vaporized, so that the fuel gas is able to enter the gas conveying pipe 242 from the gas discharging nozzle 241 so as to be rapidly ejected from the gas ejecting nozzle for entering a combustion device 25, so that a combustion operation can be processed.

The fuel gas controlling device 24 further has a gas discharging press plate 243, the gas discharging press plate 243 is pivoted to a support shaft 224 arranged in the gas combustor 2, one end of the gas discharging press plate 243 is connected to the gas discharging nozzle 241, and another end thereof is arranged adjacent to a push rod 212 (as shown in FIG. 2 and FIG. 6) of the press button 21. When the gas discharging press plate 243 is pushed by the push rod 212 of the press button 21, the gas discharging nozzle 241 is lifted through a moment effect so as to form a fuel gas supplying status, so that the fuel gas is able to pass the gas conveying pipe 242 and ejected from the gas ejecting nozzle so as to enter the combustion device 25. Moreover, the press button 21 is extended with a push arm 213 corresponding to a top end of the swing arm 12, thereby allowing the swing arm 12 to be pushed for rotations.

A piezoelectric device 214 is disposed in the pressing button 21, the piezoelectric device 214 has an electric conducting wire (known as a prior art therefore not shown in figures) extending to the combustion device 25.

A spring rod 215 of the press button 21 is further sleeved with an auxiliary spring 216, two ends of the auxiliary spring 216 are respectively arranged to be adjacent to the spring rod 215 of the press button 21 and the inner wall of the gas combustor 2, so that the press button 21 can be assisted for being elastically recovered to an initial position.

With the above-mentioned illustrations to each of the components, FIG. 3 illustrates an assembled status of the gas combustor 2, and FIG. 4 to FIG. 6 illustrate cross sectional views of FIG. 3 respectively taken along an A-A line, a B-B line and a C-C line.

Please refer to FIG. 5, when the press button 21 and the safety switch 1 are not in an operating status, the locking hook 115 is adjacent to the latching hook 121, and the locking bolt 211 is abutted against the locking member 11, thereby forming a non-pressing locked status. At this moment, the longitudinal spring 112 and the transversal spring 124 are both in a stretched (energy releasing) status.

Figure 7:
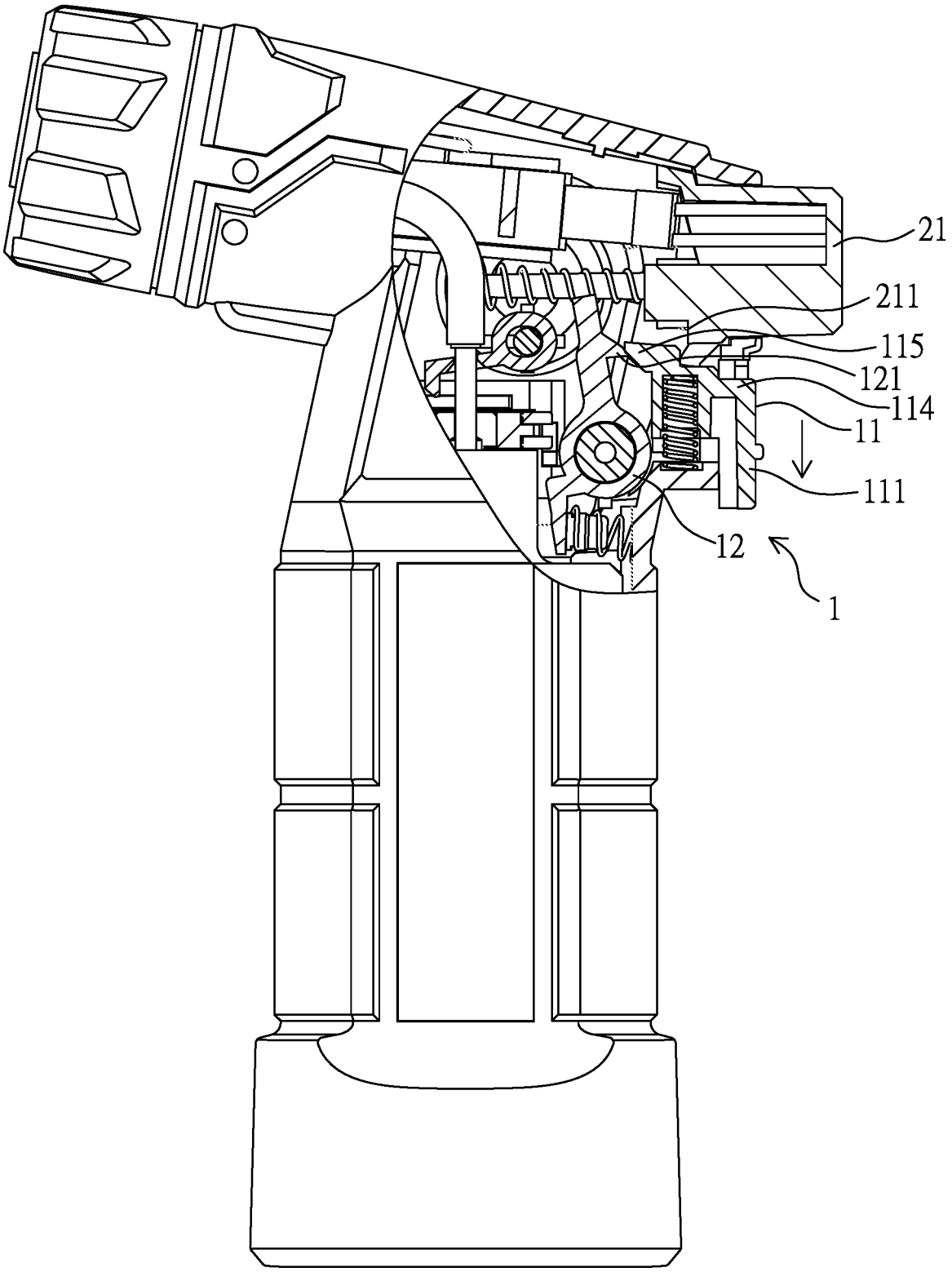
FIG. 7 and FIG. 8 are cross sectional views illustrating an unlocking procedure of the safety switch according to the present invention.
Figure 8:
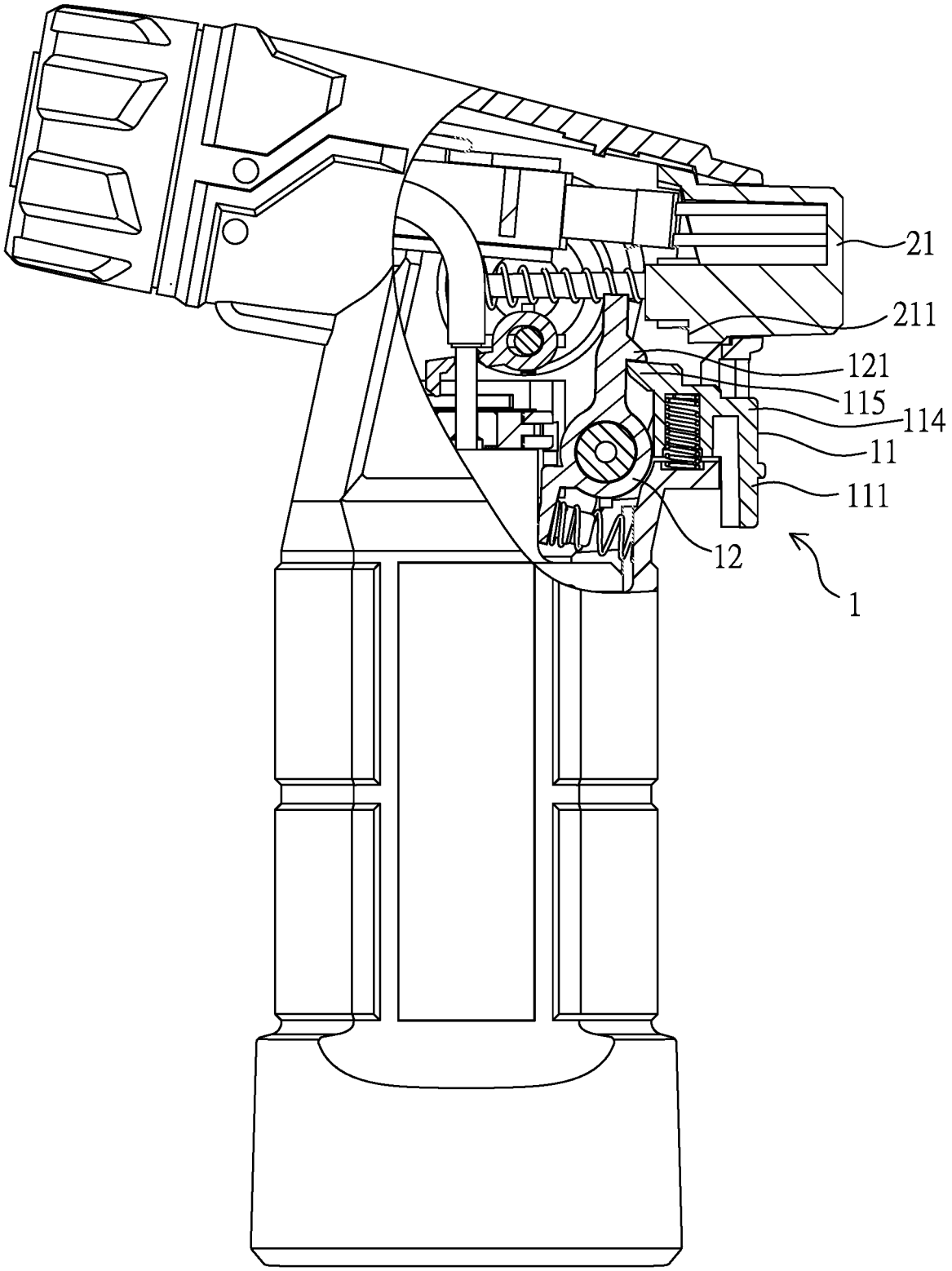

Please refer to FIG. 7 and FIG. 8, which are cross sectional views illustrating an unlocking procedure of the locking member 11 of the safety switch 1. When the unlocking procedure is desired to be processed, the push piece 114 of the locking member 11 is longitudinally and downwardly pressed through the slide rail mechanism by a user, the longitudinal spring 112 is compressed, and the locking hook 115 at the top end of the main body 111 is downwardly displaced along the latching hook 121 of the swing arm 12 so as to form a mutual abutting status, thus the locking bolt 211 is no longer provided with the abutting effect of the locking member 11, thereby forming a pressing unlocked status.

Figure 9:
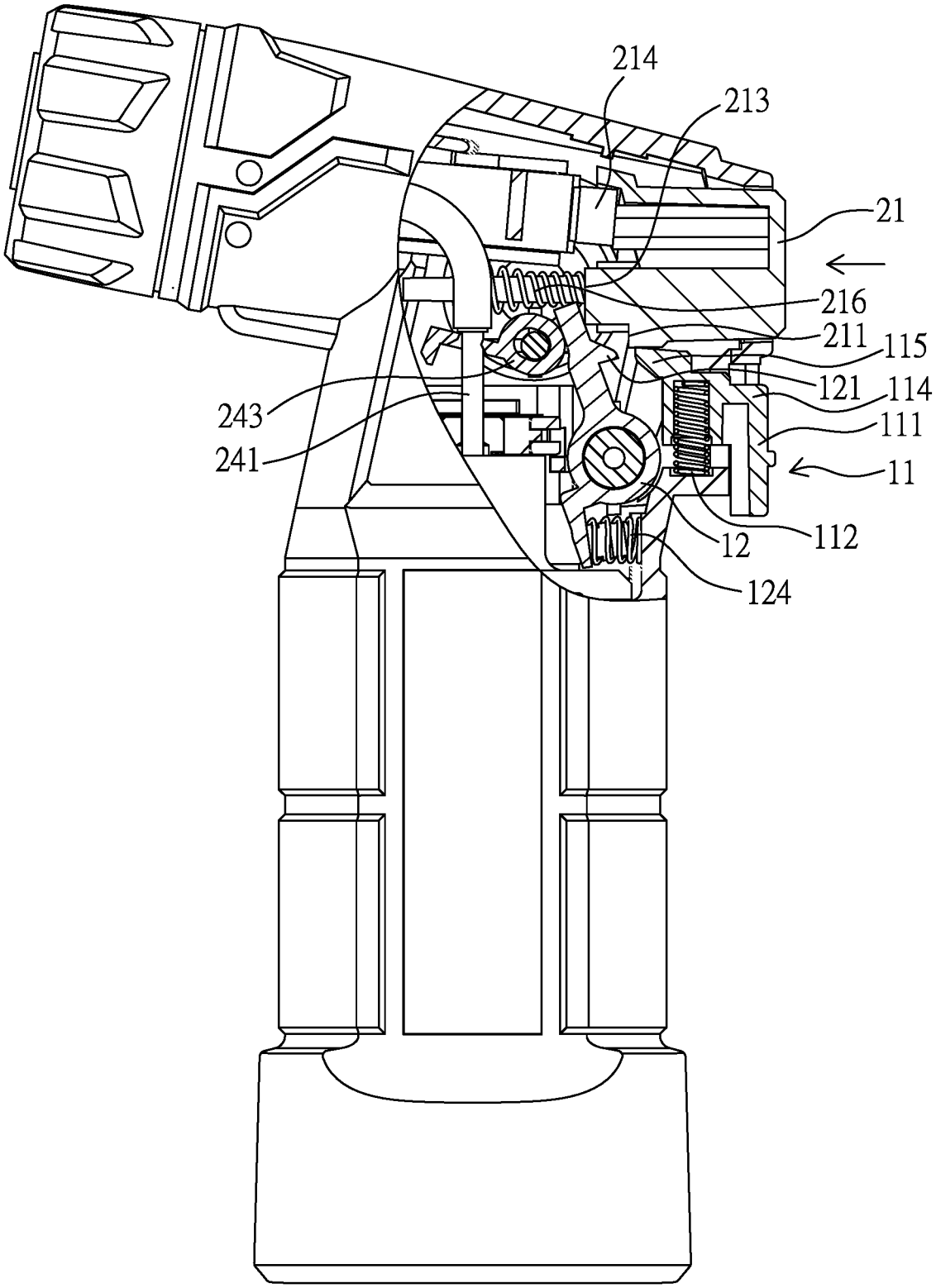
FIG. 9 is a cross sectional view illustrating the press button being pressed after the safety switch being unlocked so as to allow the swing arm to move according to the present invention.
Figure 10:
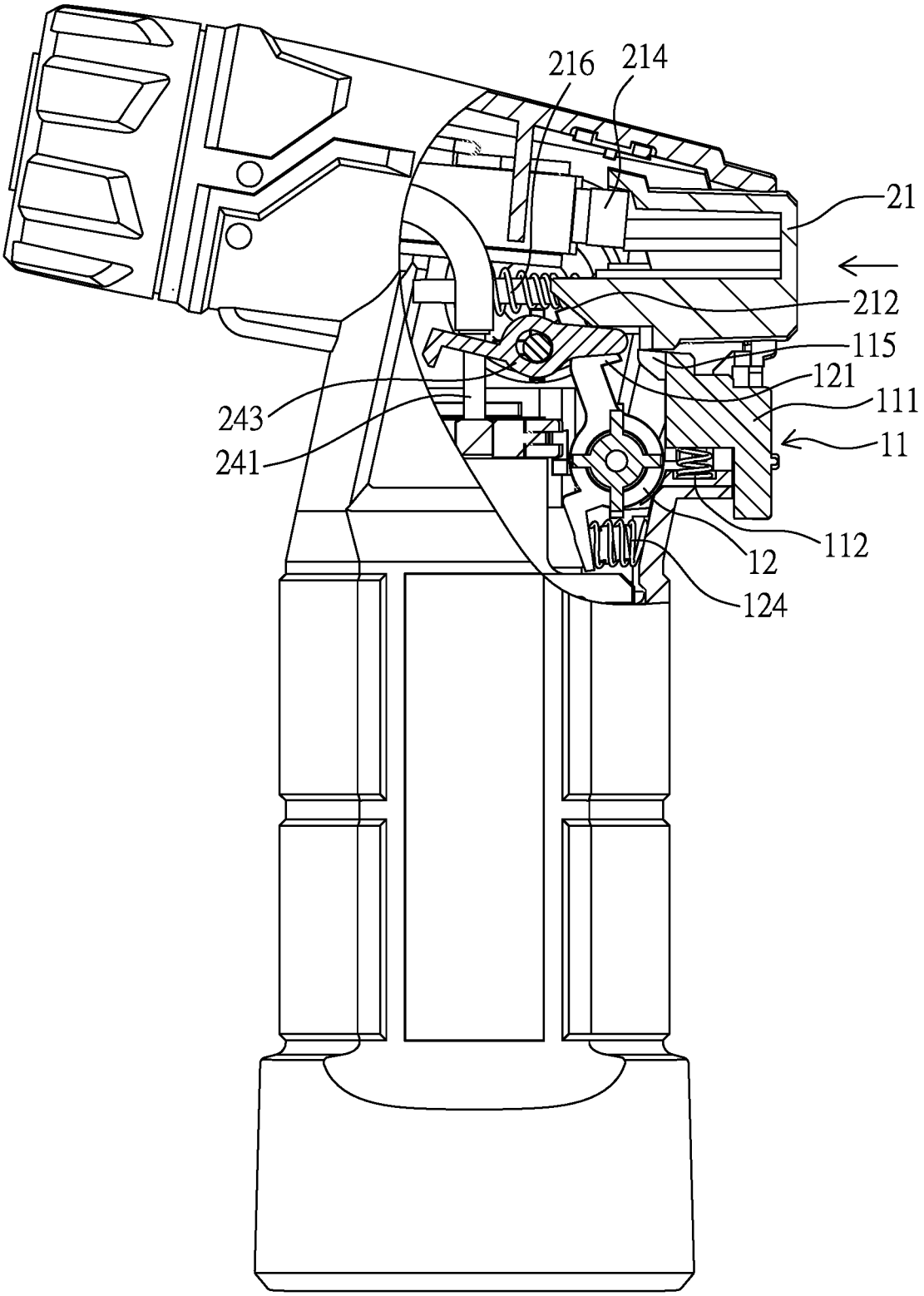
FIG. 10 is a cross sectional view illustrating the press button being pressed after the safety switch being unlocked thereby forming a fuel gas supplying status according to the present invention.

Please refer to FIG. 9 and FIG. 10, at this moment, the press button 21 can be pressed by the user for pressing the piezoelectric device 214 and the auxiliary spring 216, the swing arm 12 and the gas discharging press plate 243 are synchronously pressed for allowing the transversal spring 124 to be in a compressed (energy storing) status as shown in FIG. 9, so that the latching hook 121 is released from the locking hook 115, and the locking member 11 is upwardly displaced via the energy releasing effect of the longitudinal spring 112 through the slide rail mechanism and a top surface thereof is in contact with the locking bolt 211; and the gas discharging press plate 243 is able to clockwise rotate for lifting the gas discharging nozzle 241, thereby forming a fuel gas supplying status (as shown in FIG. 10), so that the fuel gas is able to be supplied to a flame nozzle for being ejected, and ignited by an electric arc generated through the electric conducting wire of the piezoelectric device 214 and the flame nozzle.

After the combustion operation is finished, the press button 21 is not pressed by the user, so that the press button 21 is able to be backwardly displaced through an energy releasing effect of the piezoelectric device 214 and the auxiliary spring 216, meanwhile the gas discharging press plate 243 is no longer supported by the press button 21 and provided with an energy releasing effect of the gas discharging nozzle 241, so that the gas discharging press plate 243 and the gas discharging nozzle 241 can be synchronously recovered to initial positions so as to terminate the supply of the fuel gas, and the flame of the flame nozzle is ceased. The locking bolt 211 is also backwardly displaced along the top surface of the locking member 11, after the locking bolt 211 is displaced to the locking hook 115 and during a process of forming the abutting status, the swing arm 12 is able to clockwise rotate through the energy releasing effect of the transversal spring 124, thus the locking hook 121 is able to move along the locking hook 115 until the automatic locked status, as shown in FIG. 5, is formed.

Based on what has been disclosed above, advantages achieved by the present invention are as follows. With the safety switch being integrated so as to be provided with dual functions of manual unlocking and automatic locking, the safety in operation and the durability of service life can be increased, because the manual unlocking procedure is relatively complicated and provided with more difficulties, an unanticipated disaster caused by children playing with the gas combustor can be assuredly prevented, thereby complying with safety regulations required by the European Union, the America and other countries. Accordingly, the safety device for use in the gas combustor provided by the present invention is novel and more practical in use comparing to prior arts.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance over the conventional structure and further complies with the patent application requirements and is submitted to the Patent and Trademark Office for review and granting of the commensurate patent rights.

What is claimed is:

1. A safety switch for use in a gas combustor, disposed on the gas combustor having a rear opening, and a press button being arranged adjacent to said rear opening; said safety switch including a locking member and a swing arm arranged to be adjacent to said locking member and pivotally connected to an inner wall of said gas combustor, wherein said locking member has a main body sleeved with a longitudinal spring, said main body has a push piece protruded from said rear opening, and a locking hook protruded from a location towards a latching hook arranged above said swing arm, wherein a transversal spring is disposed between an extending sheet below said swing arm and said inner wall of said gas combustor; when said push piece is not pressed, said locking hook is abutted against said latching hook, said locking hook of said main body is located between said latching hook and a push arm of the press button, and a locking bolt protruded from a bottom end of said press button is abutted against said locking hook, so that said press button is unable to be pressed, thereby forming a locked status; when said push piece is longitudinally and downwardly pressed, said longitudinal spring is compressed, and said locking hook of said main body is downwardly displaced along said latching hook and a top of said locking hook of said main body engages a bottom of said latching hook to form a mutual abutting status and said locking hook of said main body is spaced apart from the locking bolt and said push arm of the press button, thus said locking bolt is no longer provided with an abutting effect of said locking member, thereby forming a pressing unlocked status and, when said press button is pressed to move horizontally, said push arm of said press button presses said latching hook and said latching hook is pivoted and released from said locking hook, and said locking member is upwardly displaced through an energy releasing effect of said longitudinal spring, and a top surface of said locking hook is in contact with said locking bolt.

2. The safety switch for use in the gas combustor as claimed in claim 1, wherein a top end of said longitudinal spring is received in a spring slot formed in a bottom end of said main body, and a bottom end thereof is abutted against an abutting sheet arranged below said rear opening.

3. The safety switch for use in the gas combustor as claimed in claim 1, wherein a slide rail mechanism is oppositely disposed on at least one lateral wall of said main body and a corresponding inner wall of said gas combustor.

4. The safety switch for use in the gas combustor as claimed in claim 3, wherein said slide rail mechanism has at least one convex rail and at least one slide rail allowing said at least one convex rail to be disposed, so that said locking member is able to elastically and longitudinally move in said rear opening through said slide rail mechanism.

5. The safety switch for use in the gas combustor as claimed in claim 1, wherein said swing arm has a shaft hole, said shaft hole is sleeved on a shaft column protruded from said inner wall of said gas combustor.

6. The safety switch for use in the gas combustor as claimed in claim 1, wherein one end of said transversal spring is sleeved with a spring tenon of said extending sheet, and another thereof is abutted against said inner wall of said gas combustor.

* * * * *